US007761959B2

(12) United States Patent
Shih

(10) Patent No.: US 7,761,959 B2
(45) Date of Patent: Jul. 27, 2010

(54) HANDLE ASSEMBLY FOR A STAMP

(76) Inventor: Shiny Shih, No. 31, Lane 349, Chungcheng S. Rd., Tainan Hsien (TW)

( * ) Notice: Subject to any disclaimer, the term of this patent is extended or adjusted under 35 U.S.C. 154(b) by 409 days.

(21) Appl. No.: 11/948,142

(22) Filed: Nov. 30, 2007

(65) Prior Publication Data

US 2009/0139060 A1 Jun. 4, 2009

(51) Int. Cl.
*E05B 1/00* (2006.01)

(52) U.S. Cl. ..... 16/436; 16/441; 16/DIG. 30; 101/405

(58) Field of Classification Search ..... 16/436, 16/441, 417, 433, DIG. 30, DIG. 40, DIG. 41; 101/405, 406, 103, 104, 109, 333, 334; 118/264, 118/265

See application file for complete search history.

(56) References Cited

U.S. PATENT DOCUMENTS

| | | | | |
|---|---|---|---|---|
| 2,079,080 | A * | 5/1937 | Melind | 101/334 |
| 2,521,286 | A * | 9/1950 | Delore | 101/405 |
| 3,661,078 | A * | 5/1972 | Hammel | 101/125 |
| 3,719,140 | A * | 3/1973 | Hammel | 101/125 |
| 4,278,024 | A * | 7/1981 | Pennington | 101/405 |
| 5,058,501 | A * | 10/1991 | Skopek | 101/334 |
| 5,709,145 | A * | 1/1998 | Shih | 101/109 |
| 2005/0155504 | A1 * | 7/2005 | Shih | 101/333 |
| 2008/0000369 | A1 * | 1/2008 | Ameshofer | 101/334 |

FOREIGN PATENT DOCUMENTS

| | | | |
|---|---|---|---|
| JP | 07186503 | A * | 7/1995 |
| JP | 11058908 | A * | 3/1999 |

* cited by examiner

*Primary Examiner*—Chuck Y. Mah
(74) *Attorney, Agent, or Firm*—LaRiviere, Grubman & Payne, LLC

(57) ABSTRACT

A handle assembly for a stamp has a frame, a handle and a connector. The handle and the connector are mounted respectively on opposite sides of the frame and connect with each other. Therefore, the connection between the handle and the connector is firm and robust and the stamp has a durable handle assembly with increased use-life and reliability.

18 Claims, 7 Drawing Sheets

HANDLE ASSEMBLY FOR A STAMP

BACKGROUND OF THE INVENTION

1. Field of the Invention

The present invention relates to a stamp, especially to a handle assembly for a stamp.

2. Description of the Prior Art

With reference to FIG. 7, a conventional stamp comprises a handle assembly (60), a stamp assembly (70) and a rod. The handle assembly (60) has a frame (61) and a handle (62).

The frame (61) is metal to be durable and has a mounting segment (611), two positioning holes (612) and two arms (613). The mounting segment (611 ) has two ends. The positioning holes (612) are formed through the mounting segment (611). The arms (613) are formed on and protrude respectively from the ends of the mounting segment (611).

The handle (62) is plastic and has a bottom, two positioning protrusions (621) and two walls (622). The positioning protrusions (621) are formed on the bottom of the handle (62) and are mounted respectively and securely in the positioning holes (612) of the frame (61). The walls (622) are formed on and protrude from the bottom of the handle (62) and each wall (622) has an end edge and a hook (623). The hook (623) protrudes transversely from the end edge of the wall (622) of the handle (62) and hooks the mounting segment (611) of the frame (61).

The stamp assembly (70) is mounted slidably between the arms (613) of the frame (61).

The rod is mounted through the arms (613) of the frame (61) and the stamp assembly (70) and allows the handle assembly (60) and the rod to slide relative to the stamp assembly (70). Therefore, pressing the handle assembly (60) down activated the stamp assembly (70) to stamp seals or data on files.

Although the conventional stamp combines the metal frame (61) and the plastic handle (62) to form a durable stamp that can sustain constant pressure, the connection between the frame (61) and the handle (62) is weak and breaks off easily causing catastrophic failure and imposing a short use-life on the conventional stamp.

To overcome the shortcomings, the present invention provides a handle assembly of a stamp to mitigate or obviate the aforementioned problems.

SUMMARY OF THE INVENTION

The main objective of the present invention is to provide a handle assembly for a stamp that has a frame, a handle and a connector. The handle and the connector are mounted respectively on opposite sides of the frame and connect with each other. Therefore, the connection between the handle and the connector is firm and robust and the stamp has a durable handle assembly with increased use-life and reliability.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
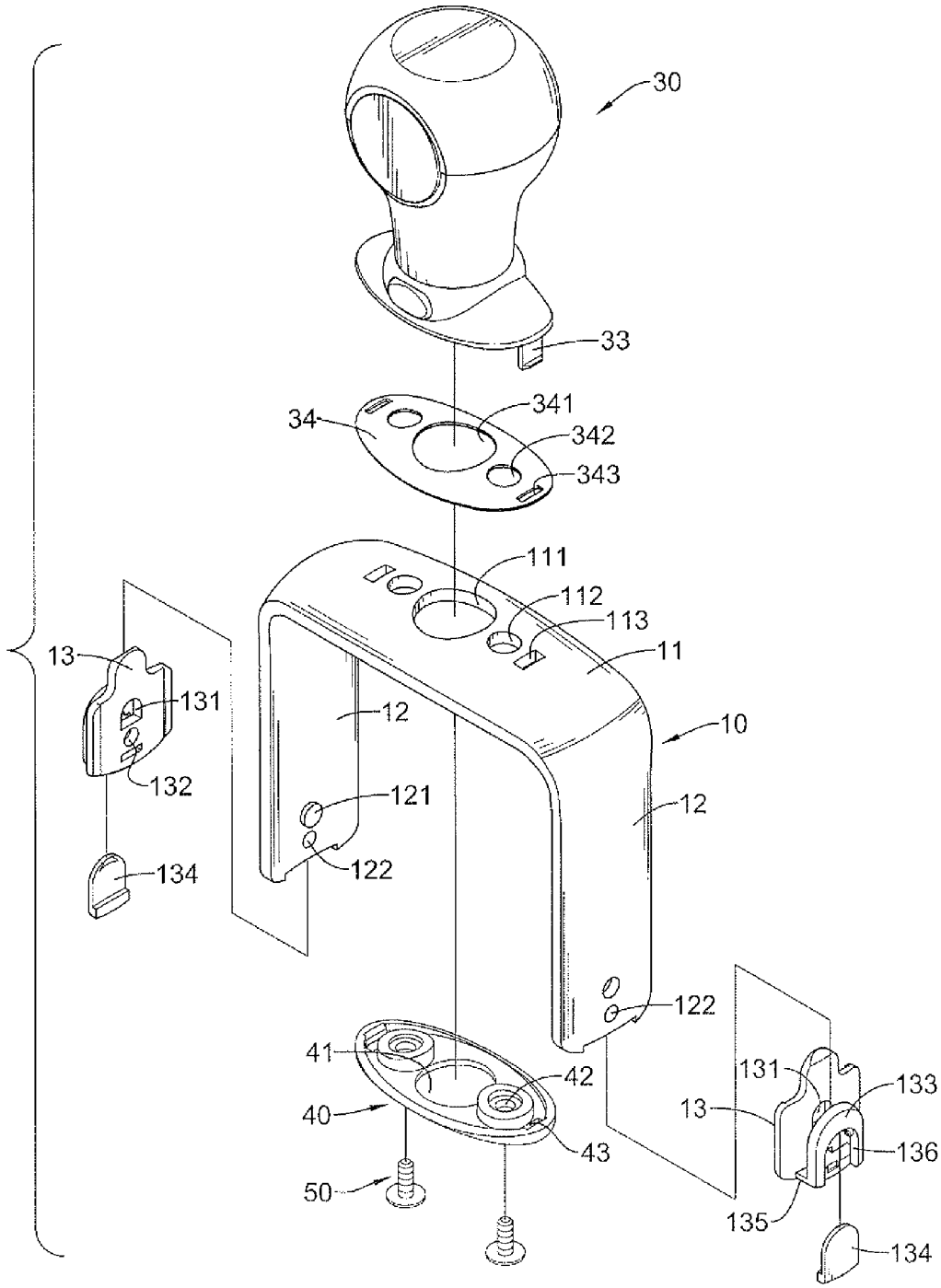
FIG. 1 is an exploded perspective view of a handle assembly of a stamp in accordance with the present invention.
Figure 3:
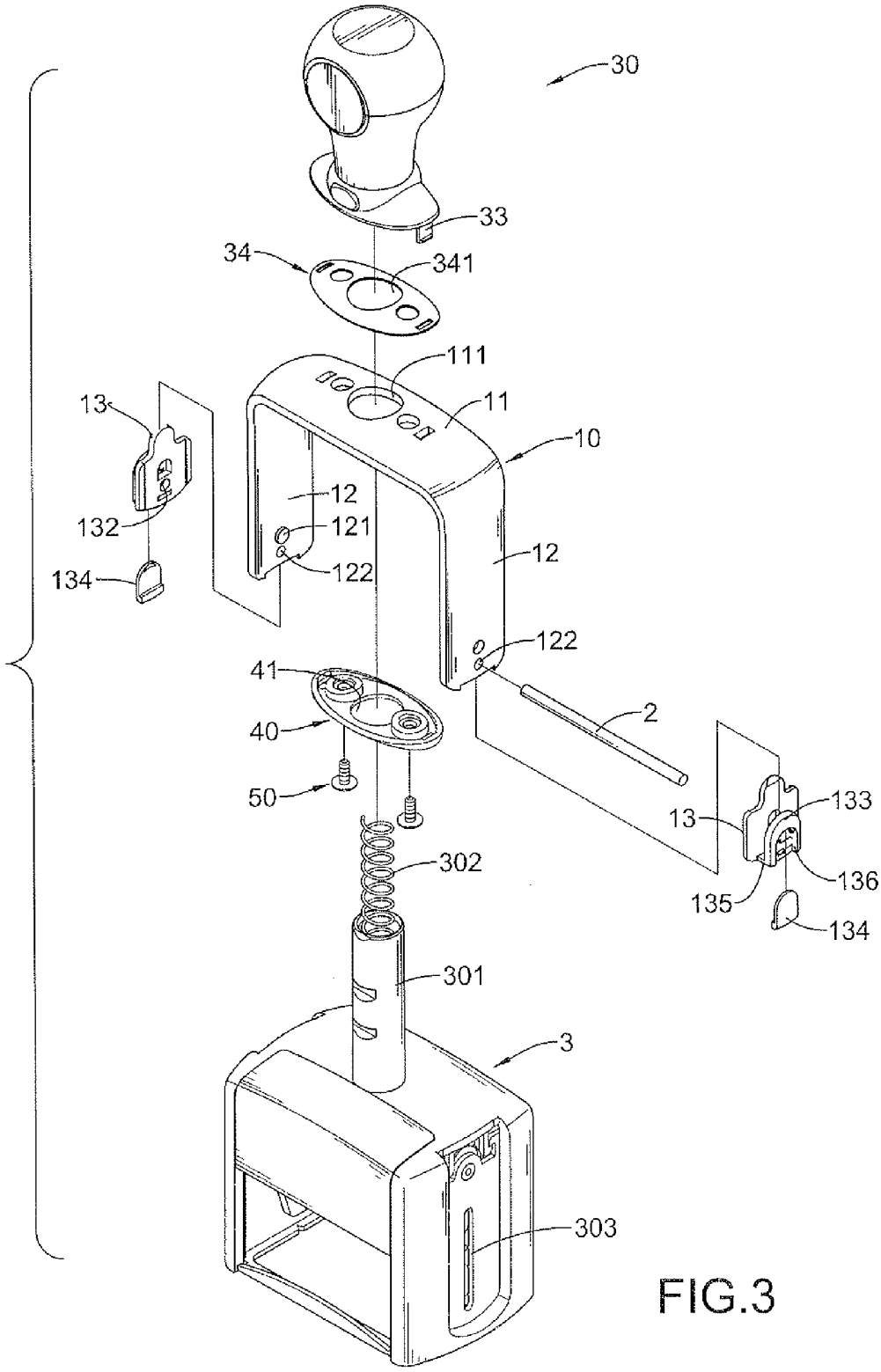
FIG. 3 is an exploded perspective view of the handle assembly in FIG. 1, shown with a stamp assembly.

With reference to FIGS. 1 and 3, a handle assembly for a stamp in accordance with the present invention is connected securely to a stamp body (3) and a rod (2) and the handle assembly comprises a frame (10), a handle (30), a connector (40), and multiple fasteners (50).

Figure 6:
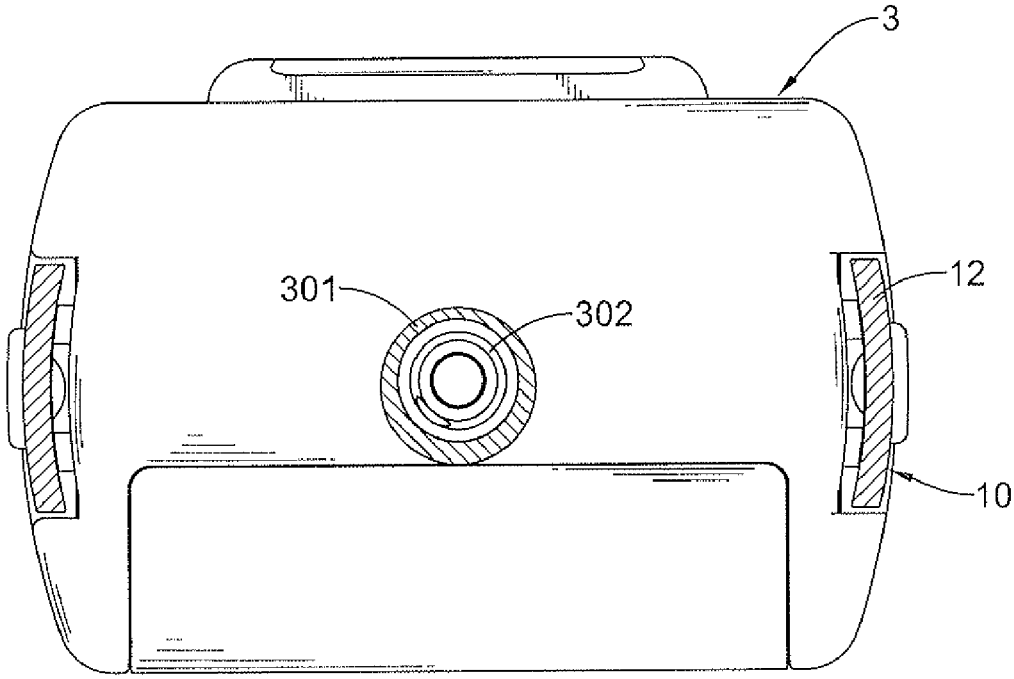
FIG. 6 is a top view in partial section of the handle assembly mounted on the stamp assembly in FIG. 4.
Figure 7:
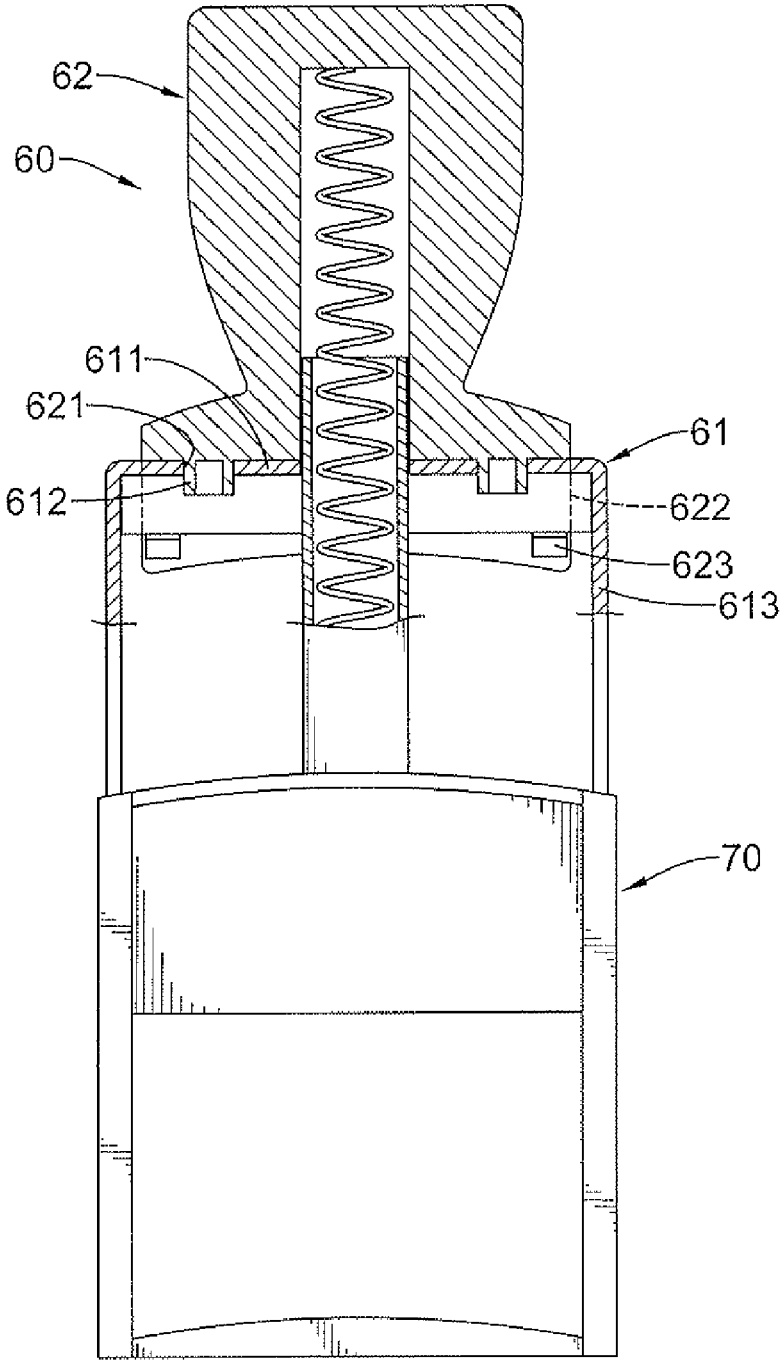
FIG.7 PRIOR ART
FIG. 7 is a front view in partial section of a conventional stamp in accordance with the prior art.

With further reference to FIG. 6, the frame (10) is metal, may be arcuate and has a mounting segment (11), two arms (12) and two optional brackets (13).

The mounting segment (11) has two ends, an outer surface, an inner surface, a mounting hole (111), two fastening holes (112) and two optional tab holes (113). The mounting hole (111) is formed through the mounting segment (11). The fastening holes (112) are formed through the mounting segment (11) adjacent to the mounting hole (111). The tab holes (113) are formed through the mounting segment (11) and respectively adjacent to the fastening holes (112).

The arms (12) are formed on and protrude respectively from the ends of the mounting segment (11) and each arm (12) has an inner surface, an outer surface, an end a pivot hole (122) and an optional protrusion (121). The pivot hole (122) is formed through the arm (12) near the end of the arm (12) and corresponds with the pivot hole (14) of the other arm (12). The protrusion (121) is formed on the inner surface of the arm (12) near the pivot hole (122).

The brackets (13) are mounted respectively on the end of the arms (12) and each bracket (13) has an inner surface, an edge, an optional positioning recess (131), a pivot hole (132), a hook (133) and an optional cover (134). The edge of the bracket (13) is disposed adjacent to the end of the arm (12). The positioning recess (131) is formed in the inner surface of the bracket (13) and is mounted around the protrusion (121) of a corresponding arm (12) to hold the bracket (13) in position. The pivot hole (132) is formed through the bracket (13) near the edge of the bracket (13). The hook (133) is formed, substantially parallel on and protrudes from the inner surface of the bracket (13) at the edge to form an arm mount (135) and has an outer surface and an optional mounting recess (136). The arm mount (135) is mounted around the end of the arm (12). The mounting recess (136) is formed in the outer surface of the hook (133). The cover (134) is mounted on the mounting recess (136) of the hook (133).

Figure 2:
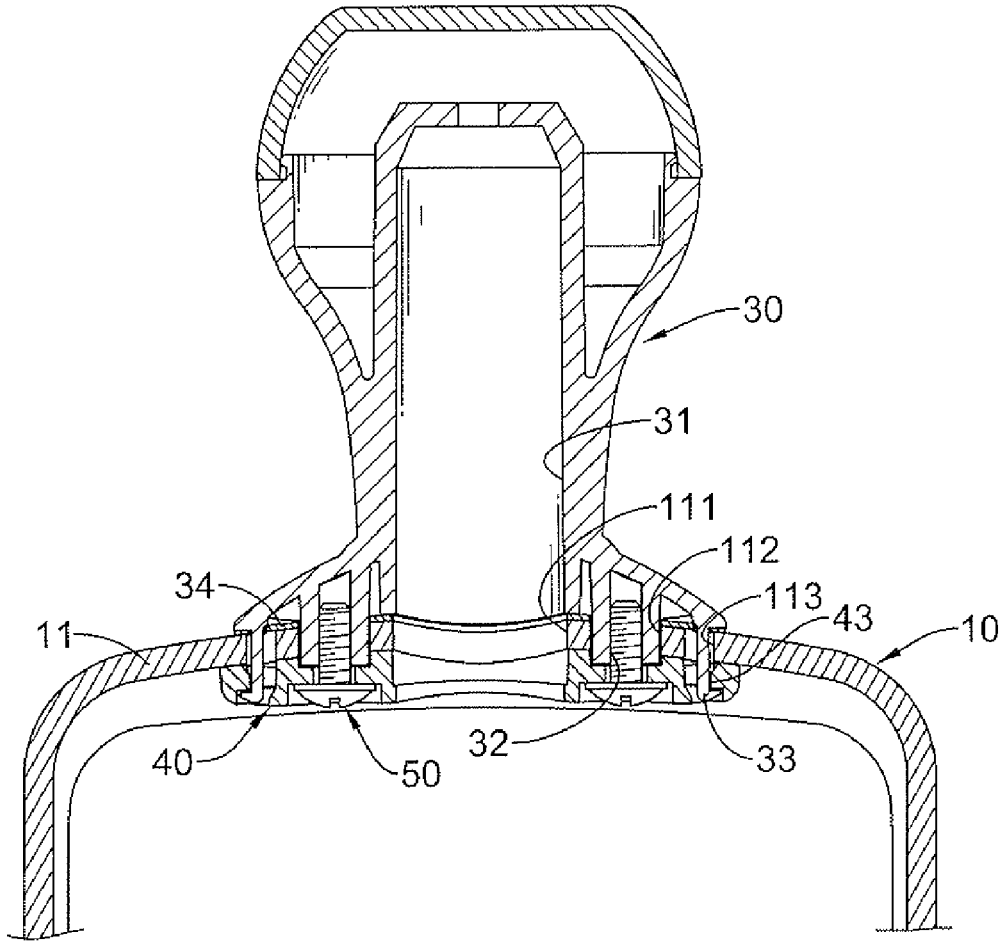
FIG. 2 is an enlarged front view in partial section of the handle assembly of the stamp in FIG. 1.

With further reference to FIG. 2, the handle (30) is plastic, is mounted on the outer surface of the mounting segment (11) of the frame (10) and has a bottom, a bottom edge, a spring recess (31), two fastening tubes (32), two optional tabs (33) and an optional washer (34).

The spring recess (31) is formed axially in the bottom of the handle (30), aligns with the mounting hole (111) of the mounting segment (11) of the frame (10).

The fastening tubes (32) protrude transversely and oppositely from the bottom of the handle (30) near the spring recess (31) and is mounted respectively through the fastening holes (112) of the mounting segment (11) of the frame (10).

The tabs (33) are formed on and protrude from the bottom edge of the handle (30) and are mounted respectively through the tab holes (113) of the mounting segment (11) of the frame (10).

The washer (34) is mounted between the outer surface of the mounting segment (11) and the bottom of the handle (30) and has a mounting hole (341), two fastening holes (342) and two tab holes (343). The mounting hole (341) is formed through the washer (34) and aligns with the mounting hole (111) of the mounting segment (11) and the spring recess (31) of the handle (30). The fastening holes (342) are formed through the washer (34) adjacent to the mounting hole (341) and are mounted respectively around the fastening tubes (32) of the handle (30). The tab holes (343) are formed respectively through the washer (34) and are mounted respectively around the tabs (33) of the handle (30).

The connector (40) is plastic, is mounted on the inner surface of the mounting segment (1) of the frame (10) and has an inner surface, a mounting hole (41), two fastening holes (42) and two optional tab recesses (43).

The mounting hole (41) is formed through the connector (40) and aligns with the mounting holes (111, 341) of the mounting segment (11) and the washer (34) and the spring recess (31) of the handle (30).

The fastening holes (42) are formed through the connector (40) adjacent to the mounting hole (41), respectively align with the fastening holes (112, 342) of the mounting segment (11) of the frame (10) and the washer (34) and are mounted respectively around the fastening tubes (32) of the handle (30).

The tab recesses (43) are formed in the inner surface of the connector (40) and respectively hook the tabs (33) of the handle (30).

The fasteners (50) are mounted respectively through the fastening holes (42, 112, 342) of the connector (40), the mounting segment (11) of the frame (10) and the washer (34) and mounted securely in the fastening tubes (32) of the handle (30) to hold the connector (40), the frame (10), the washer (34) and the handle (30) together securely.

Figure 4:
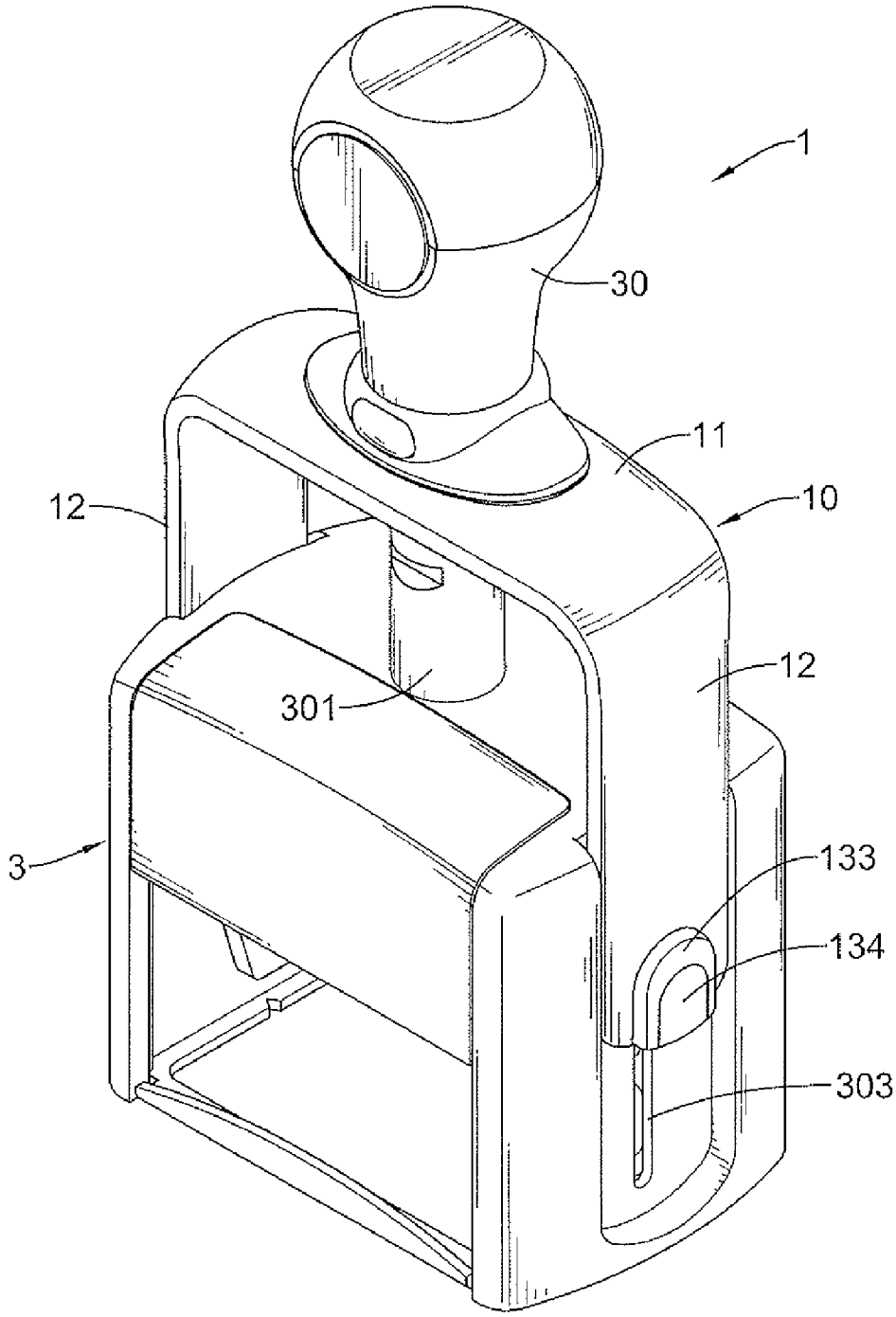
FIG. 4 is a perspective view of the handle assembly in FIG. 1, shown mounted on a stamp assembly.
Figure 5:
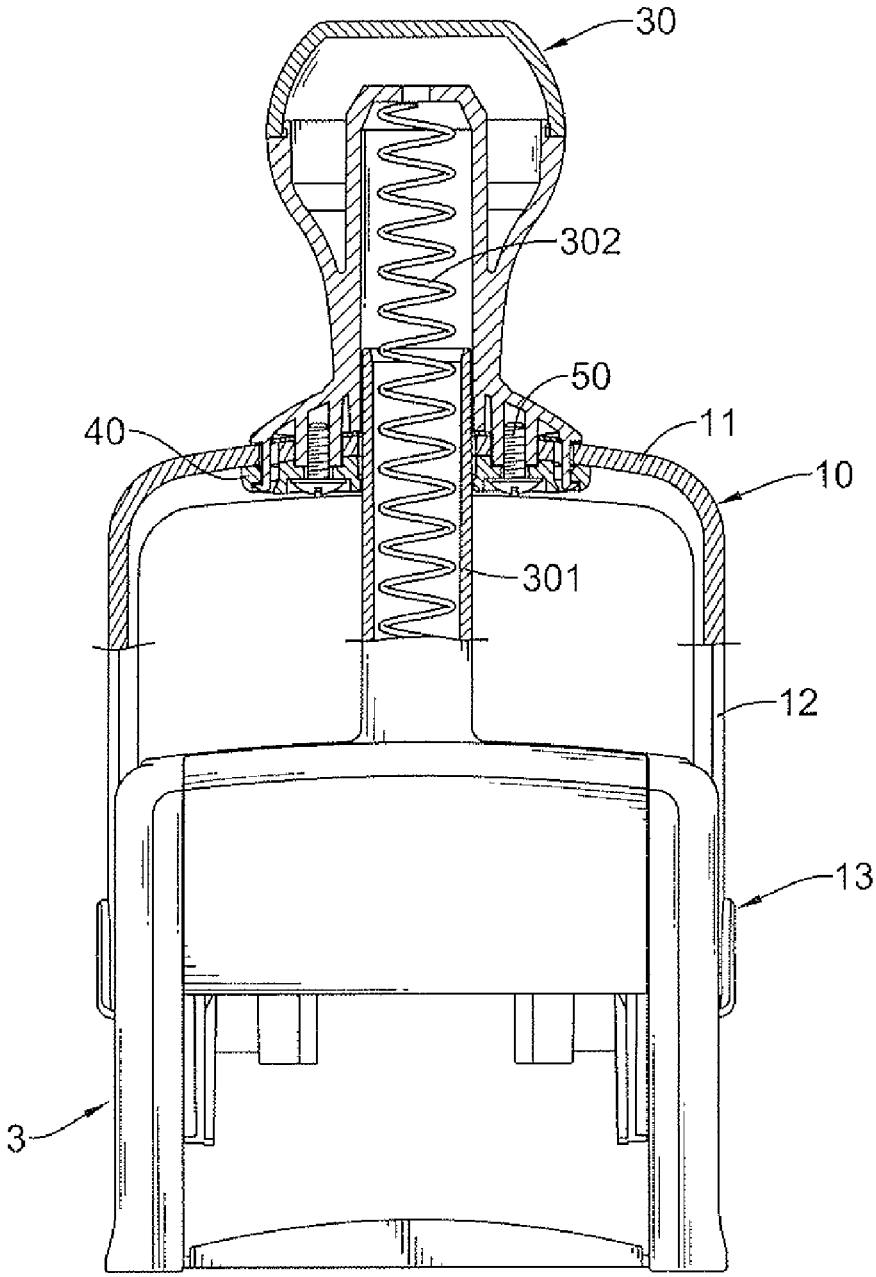
FIG. 5 is a front view in partial section of the handle assembly mounted on the stamp assembly in FIG. 4.

With further reference to FIGS. 4 and 5, the stamp body (3) is mounted between the arms (12) of the frame (10) and has a top surface, two sidewalls, two guide slots (303), a spring tube (301) and a spring (302). The sidewalls are disposed opposite to each other and are mounted slidably on the inner surface of the arms (12) of the frame (10). The guide slots (303) are formed respectively through the sidewalls of the stamp body (3). The spring tube (301) is formed on and protrudes from the top surface of the stamp body (3) and is mounted slidably in the spring recess (31) of the handle (30). The spring (302) is mounted in the spring tube (301) of the stamp body (3) and the spring recess (31) of the handle (30) and presses the handle assembly away from the stamp body (3).

The rod (2) is mounted through the pivot holes (132, 122) of the brackets (131) and the arms (12) of the frame (10) and slidably through the guide slots (303) of the stamp body (3) to allow the rod (2) and the handle assembly to slide relative to the stamp body (3).

The handle assembly for the stamp as described has the following advantages. The handle (30) and the connector (40) are mounted respectively on the opposite sides of the frame (10) and connect with each other. Therefore, the connection between the handle (30) and the connector (40) is firm and durable. Since the frame (10) is arcuate in cross-section, the frame (10) can sustain great force and many repetitions. Furthermore, the tabs (33) are mounted respectively through tab holes (113) of the mounting segment (11) of the frame (10) and hook the tab recesses (43) of the connector (40), so connection between the handle (30) and the frame (10) is sturdy and reliable.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. A handle assembly for a stamp comprising a frame being metal and having a mounting segment having two ends;

an outer surface;

an inner surface;

a mounting hole being formed through the mounting segment; and two fastening holes being formed through the mounting segment adjacent to the mounting hole; and two arms being formed on and protruding respectively from the ends of the mounting segment and each arm having an inner surface;

an outer surface;

an end; and a pivot hole being formed through the arm near the end of the arm and corresponding with the pivot hole of the other arm;

a handle being plastic, being mounted on the outer surface of the mounting segment of the frame and having a bottom;

a bottom edge;

a spring recess being formed axially in the bottom of the handle, aligning with the mounting hole of the mounting segment of the frame; and two fastening tubes protruding transversely and oppositely from the bottom of the handle near the spring recess and being mounted respectively through the fastening holes of the mounting segment of the frame;

a connector being plastic, being mounted on the inner surface of the mounting segment of the frame and having an inner surface;

a mounting hole being formed through the connector and aligning with the mounting hole of the mounting segment and the spring recess of the handle; and two fastening holes being formed through the connector adjacent to the mounting hole, respectively aligning with the fastening holes of the mounting segment of the frame and being mounted respectively around the fastening tubes of the handle; and multiple fasteners being mounted respectively through the fastening holes of the connector and the mounting segment of the frame and mounted securely in the fastening tubes of the handle.

2. The handle assembly for the stamp as claimed in claim 1, wherein the mounting segment of the frame further has two tab holes being formed through the mounting segment and respectively adjacent to the fastening hole;

the handle further has two tabs being formed on and protruding from the bottom edge of the handle and being mounted respectively through the tab holes of the mounting segment of the frame; and the connector further has two tab recesses being formed in the inner surface of the connector and respectively hooking the tabs of the handle.

3. The handle assembly for the stamp as claimed in claim 2, wherein the handle further has a washer being mounted between the outer surface of the mounting segment and the bottom of the handle and having a mounting hole being formed through the washer and aligning with the mounting hole of the mounting segment and the spring recess of the handle; and two fastening holes being formed through the washer adjacent to the mounting hole and being mounted respectively around the fastening tubes of the handle; and two tab holes being formed respectively through the washer and being mounted respectively around the tabs of the handle.

4. The handle assembly for the stamp as claimed in claim 3, wherein the frame further has two brackets being mounted respectively on the ends of the arms and each bracket having an inner surface;

an edge being disposed adjacent to the end of the arm;

a pivot hole being formed through the bracket near the edge of the bracket; and a hook being formed substantially parallelly on and protruding from the inner surface of the bracket at the edge to form an arm mount being mounted around the end of a corresponding one of the arms and the hook having an outer surface.

5. The handle assembly for the stamp as claimed in claim 4, wherein the hook of each bracket further has a mounting recess being formed in the outer surface of the hook; and each bracket further has a cover being mounted on the mounting recess of the hook on the bracket.

6. The handle assembly for the stamp as claimed in claim 5, wherein each arm further has a protrusion being formed on the inner surface of the arm near the pivot hole; and each bracket further has a positioning recess being formed in the inner surface of the bracket and being mounted around the protrusion of a corresponding arm.

7. The handle assembly for the stamp as claimed in claim 6, wherein the frame is arcuate.

8. The handle assembly for the stamp as claimed in claim 4, wherein each arm further has a protrusion being formed on the inner surface of the arm near the pivot hole; and each bracket further has a positioning recess being formed in the inner surface of the bracket and being mounted around the protrusion of a corresponding arm.

9. The handle assembly for the stamp as claimed in claim 2, wherein the frame further has two brackets being mounted respectively on the ends of the arms and each bracket having an inner surface;

an edge being disposed adjacent to the end of the arm;

a pivot hole being formed through the bracket near the edge of the bracket; and a hook being formed substantially parallelly on and protruding from the inner surface of the bracket at the edge to form an arm mount being mounted around the end of a corresponding one of the arms and the hook having an outer surface.

10. The handle assembly for the stamp as claimed in claim 9, wherein the hook of each bracket further has a mounting recess being formed in the outer surface of the hook; and each bracket further has a cover being mounted on the mounting recess of the hook on the bracket.

11. The handle assembly for the stamp as claimed in claim 10, wherein each arm further has a protrusion being formed on the inner surface of the arm near the pivot hole; and each bracket further has a positioning recess being formed in the inner surface of the bracket and being mounted around the protrusion of a corresponding arm.

12. The handle assembly for the stamp as claimed in claim 11, wherein the frame is arcuate.

13. The handle assembly for the stamp as claimed in claim 9, wherein each arm further has a protrusion being formed on the inner surface of the arm near the pivot hole; and each bracket further has a positioning recess being formed in the inner surface of the bracket and being mounted around the protrusion of a corresponding arm.

14. The handle assembly for the stamp as claimed in claim 1, wherein the frame further has two brackets being mounted respectively on the ends of the arms and each bracket having an inner surface;

an edge being disposed adjacent to the end of the arm;

a pivot hole being formed through the bracket near the edge of the bracket; and a hook being formed substantially parallelly on and protruding from the inner surface of the bracket at the edge to form an arm mount being mounted around the end of a corresponding one of the arms and the hook having an outer surface.

15. The handle assembly for the stamp as claimed in claim 14, wherein the hook of each bracket further has a mounting recess being formed in the outer surface of the hook; and each bracket further has a cover being mounted on the mounting recess of the hook on the bracket.

16. The handle assembly for the stamp as claimed in claim 15, wherein each arm further has a protrusion being formed on the inner surface of the arm near the pivot hole; and each bracket further has a positioning recess being formed in the inner surface of the bracket and being mounted around the protrusion of a corresponding arm.

17. The handle assembly for the stamp as claimed in claim 16, wherein the frame is arcuate.

18. The handle assembly for the stamp as claimed in claim 14, wherein each arm further has a protrusion being formed on the inner surface of the arm near the pivot hole; and each bracket further has a positioning recess being formed in the inner surface of the bracket and being mounted around the protrusion of a corresponding arm.

* * * * *